United States Patent [19]

Waldvogel et al.

[11] Patent Number: 4,759,391

[45] Date of Patent: Jul. 26, 1988

[54] TWO LAYER PAPERMACHINE EMBOSSING FABRIC WITH DEPRESSIONS IN THE UPPER FABRIC LAYER FOR THE PRODUCTION OF TISSUE PAPER

[75] Inventors: Hartmut Waldvogel; Georg Borel, both of Reutlingen, Fed. Rep. of Germany

[73] Assignee: Wangner GmbH & Co. KG, Reutlingen, Fed. Rep. of Germany

[21] Appl. No.: 1,939

[22] Filed: Jan. 9, 1987

[30] Foreign Application Priority Data

Jan. 10, 1986 [DE] Fed. Rep. of Germany ..... 3600530

[51] Int. Cl.[4] ..... D21F 1/10; D03D 11/00

[52] U.S. Cl. ..... 139/383 A; 139/425 A; 139/413; 162/348; 162/DIG. 1; 162/362; 162/116

[58] Field of Search ..... 162/DIG. 1, 348, 362, 162/300, 116; 139/408–413, 383 A, 425 A

[56] References Cited

U.S. PATENT DOCUMENTS

| | | | |
|---|---|---|---|
| 3,322,617 | 5/1967 | Osborne | 162/116 |
| 3,834,983 | 9/1974 | Conway et al. | 162/116 |
| 4,187,618 | 2/1980 | Diehl | 162/358 |
| 4,382,987 | 5/1983 | Smart | 162/358 |
| 4,415,625 | 11/1983 | Borel | 162/DIG. 1 |
| 4,611,639 | 9/1986 | Bugge | 139/383 A |

FOREIGN PATENT DOCUMENTS

| | | | |
|---|---|---|---|
| 141791 | 5/1985 | European Pat. Off. | 139/383 A |
| 3329740 | 3/1985 | Fed. Rep. of Germany | 139/383 A |

*Primary Examiner*—David L. Lacey
*Assistant Examiner*—K. M. Hastings
*Attorney, Agent, or Firm*—Sughrue, Mion, Zinn, Macpeak, and Seas

[57] ABSTRACT

A papermachine fabric for the production of tissue paper or porous batts has a two layer fabric comprised of a fine upper fabric layer and a coarser lower fabric layer. Both fabric layers have a large open area. The two fabric layers are firmly interconnected so that the upper fabric layer exhibits depressions at the sites of interweaving which are distributed in the manner of a pattern. The papermachine fabric is especially suited as an embossing fabric for after drying the paper web coming from a sheet forming fabric or as a second sheet former of a twin wire former.

7 Claims, 5 Drawing Sheets

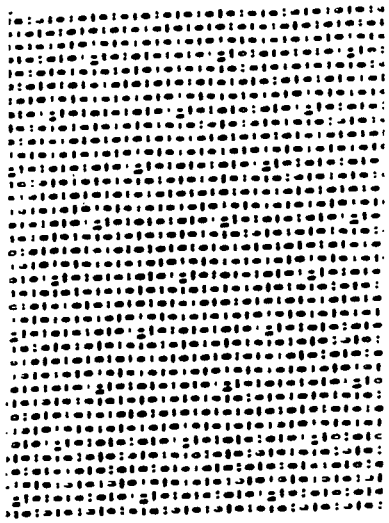
FIG. 1
PRIOR ART
FIG. 2
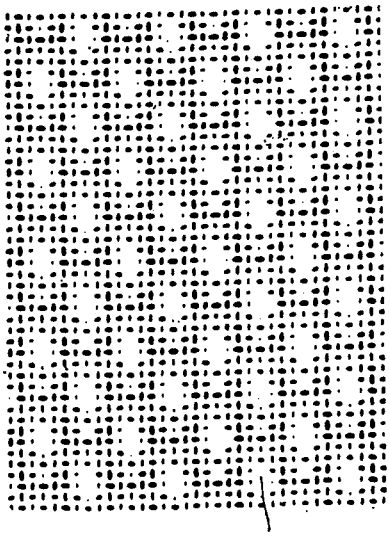
FIG. 3
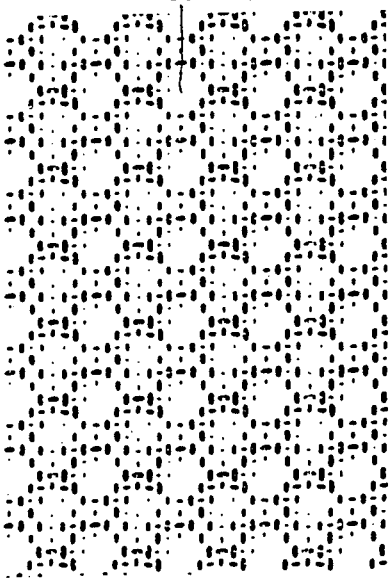

TWO LAYER PAPERMACHINE EMBOSSING FABRIC WITH DEPRESSIONS IN THE UPPER FABRIC LAYER FOR THE PRODUCTION OF TISSUE PAPER

BACKGROUND OF THE INVENTION

The invention relates to the use of a papermachine fabric for the production of tissue paper or a porous batt. The papermachine fabric consists of two interconnected fabric layers with the lower fabric layer being coarser, i.e., having lesser density of longitudinal and transverse wires with said longitudinal and transverse wires having a larger diameter than those in the upper fabric layer. The invention further relates to papermachine fabrics which are especially suited for the manufacture of tissue paper or a porous batt.

Conventional two layer papermachine fabrics of the type described in EP-A-No. 0,044,053, DE-A-No. 2,455,184 and U.S. Pat. Nos. 2,455,185; 2,917,694; 3,305,713; and 3,329,740, are used for the manufacture of paper, e.g. newsprint, and are not suited for the manufacture of tissue paper or a porous batt where structuring by different fiber density or pattern-like fiber concentration is desirable.

It has been known in the manufacture of porous tissue paper to provide sheet forming fabrics with projecting impermeable synthetic resin areas distributed in the manner of a pattern on which no sheet forming takes place and therefore holes are left in the paper sheet (DE-A-No. 1,786,414). Furthermore, it has been known to form thin areas in the paper web during sheet forming on a very coarse fabric by projecting warp knuckles (U.S. Pat. No. 1,102,246).

It is also possible to emboss a soft, bulky tissue paper web by a so called embossing fabric in such a way that compacted areas alternate with soft material in the paper (U.S. Pat. Nos. 3,301,746; 3,629,056; 3,905,863; and 4,440,597, and DE-A-Nos. 2,820,499; and 3,008,344). The moist paper web in this process is supported by a coarse fabric. When hot air is forced through fabric, the paper web assumes the configuration of the supporting fabric area and the hot air stream forces the batt into the depressions between the projecting warp knuckles. In all these cases single layer fabrics are used and the embossed pattern depends on the fabric weave. The height of the projecting embossing knuckles is predetermined by the fabric structure which, in turn, is variable to only a limited extent. In order to make the embossed areas more pronounced, the surface of the projecting warp knuckles is abraded.

Recently a method has become known (EP-A-Nos. 0,135,231, and 0,140,404) in which the paper web is embossed with a honeycomb-like pattern. After the paper web has been formed on the sheet forming fabric the moist web is taken over by the embossing fabric and deformed in the desired way. Said embossing fabric consists of very fine fabric with 17 longitudinal and 18 transverse wires, each having a 1.18 mm diameter. The open area amounts to forty-five percent. A hexagonal honeycomb structure of photosensitive resin is applied to the fabric. The paper web is drawn into the depressions of the embossing fabric by the action of a suction box whereby the fiber structure of the paper web is changed. The paper web is after dried on the embossing fabric from about ten percent to sixty-five percent, first by the action of the suction box and thereafter by blowing hot air therethrough. The paper web is then pressed onto a heating cylinder by a pressure roll. This pressing treatment intensifies the embossed honeycomb structure because the embossing fabric travels between the pressing roll and the paper web. In order to increase the adhesion of the paper web to the drying cylinder an auxiliary adhesive is sprayed onto the web and onto the cylinder.

The paper produced with this method meets the product requirements by the method has the disadvantage that the embossing fabric is very weak and unstable. The supporting fabric must be very open and has but low stability in the longitudinal and transverse directions, a fact which promotes the formation of ridges and folds. Furthermore, it is extremely complicated and expensive to produce the honeycomb structure. Also, the photosensitive resin causes high abrasion at the suction box which is a drawback where high friction soon wears down the very fine fabric on the running side. A major problem is soiling of the fabric by the auxiliary adhesive employed by which the paper web is adhered to the heating cylinder. The fabric must be continuously cleaned with a highly pressurized water jet. Although the adhesive is rinsed off, the webs of the honeycomb pattern may break off and after a short time the embossing wire becomes useless.

SUMMARY OF THE INVENTION

The invention is concerned with the problem of simplifying the manufacture of tissue paper and porous batts and to provide a papermachine fabric suited for this purpose which has a long service life and can be cleaned in a simple manner.

According to the invention, tissue paper and porous batts are produced with the use of a two layer papermachine fabric in which both fabric layers have a large open area and the upper fabric layer has depressions at the bonding sites which are distributed in the manner of a pattern.

The tissue paper or porous batt may be produced such that the papermachine fabric is used as an embossing wire for after drying the paper web removed from a sheet forming fabric or as an embossing fabric serving as the second sheet forming fabric of a twin wire former.

The papermachine fabric used according to the invention is a two layer fabric, i.e., it consists of two separate fabric layers. The two fabric layers are interconnected by additional binder wires or by the structural longitudinal and/or transverse wires of the upper fabric layer. The upper fabric layer is very fine and open. Both the upper and lower fabric layer may be woven in any desired weave customary for sheet forming fabric. For the upper fabric layer a plain weave is advantageous because a plain weave offers the maximum number of small knuckles supporting the fibers.

However, the upper fabric layer may also be a three harness twill, a four harness twill, or an even higher harness twill. The lower fabric layer preferably is woven in plain weave or three harness twill; however, it may as well be woven in four harness twill, cross twill (crow foot), five harness satin or a double layer weave.

Polyester monofilament of a hydrolysis resistant grade is especially well suited as material for both fabric layers. However, polyamide monofilament or heat resistant polypropylene monofilament may be employed.

The material for the binder wires preferably is a hard polyester grade of high elastic modulus, as customarily used for the longitudinal wires of sheet formers. These binder wires of low deformability draw the soft upper fabric layer deeply into the interstices of the coarse lower fabric layer. Depending on the fabric weave, the depth of the dimples ranges from 0.20 to 0.40 mm. Since the longitudinal wires of the upper fabric layer are disposed in offset relation to those of the lower fabric layer, it is possible to draw the upper fabric layer into the interstices in the lower fabric layer.

If the two fabric layers are interconnected by the structural longitudinal or transverse wires of the upper fabric layer, there is no need to use softener synthetic resin wire for the upper fabric layer. The coarser structure of the lower fabric layer and the interweaving of the structural wires of the upper fabric layer are already sufficient to form pronounced depressions in the paper face of the upper fabric layer.

The papermachine fabric of the invention can be woven flat (open) or endless. Preferably it is woven flat and is made endless by a woven seam.

The upper fabric layer consists, for example, of twenty-five longitudinal wires/cm of 0.16 mm diameter and twenty-five transverse wires/cm of 0.15 mm diameter. The longitudinal and transverse wires of the upper fabric layer are made from soft, readily deformable synthetic resin material, e.g., polyester of the Trevira 900 C type (Hoechst). The upper fabric layer per se has little longitudinal and transverse stability. The lower fabric layer is coarser and supports the upper fabric layer. In this example it consists of 12.5 longitudinal and transverse wires/cm of 0.25 mm diameter. The longitudinal wires consist of the harder polyester Trevira 920 C type, and the transverse wires have medium softness and consist of the polyester Trevira 901 C type. The upper and lower fabric layers each have an open area greater than 30%. The upper fabric layer has an open area of about thirty-eight percent and the lower fabric layer has an open area of forty-four percent. The fabric as a whole is highly permeable to air and has an air permeability of 750 cfm. Both fabric layers are interconnected by binder wires extending in transverse and longitudinal directions. It is also possible to bond the two fabric layers together by interweaving structural wires of the upper fabric layer into the lower fabric layer.

Conventional two layer papermachine fabrics employed as sheet formers possess a smooth paper face of fine structure, while the coarse fabric layer on the running side insures stability and abrasion resistance. The smooth uniform surface of the paper face does not have any discontinuities or irregularities in the fabric texture. All the warp and weft wire knuckles appear as small supporting areas on the top side of the fabric. This is prerequisite for sheet forming fabrics because otherwise undesirable marks would be produced in the paper sheet.

The papermaking fabric of the invention, on the other hand, is an embossing wire and differs fundamentally from the sheet forming fabrics in that its surface is not smooth. Rather it consists of a pattern of alternately occurring depressions or dimples with intermediate webs of undeformed fabric on the paper side. The size, depth, surface configuration and distribution of the dimples can be selected so as to produce the desired structure of the paper web in that the sites where the two fabric layers are interconnected are accordingly shaped and arranged.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 shows the imprint of a two layer sheet former of the prior art with a monoplanar paper face.

FIGS. 2 and 3 show the imprint of a papermachine fabric according to the invention with small and large depressions on the paper face discernible as white areas.

DETAILED DESCRIPTION OF THE INVENTION

FIG. 1 shows the imprint of a conventional two layer papermachine fabric having a monoplanar paper face as used, for example, as a sheet former for newsprint. The knuckles of all the longitudinal wires and transverse wires appear as small, mostly oval supporting areas on the top side of the sheet former, i.e., the paper face. The monoplanar surface of the paper face is an essential feature of the conventional sheet forming fabrics because otherwise undesirable marks would occur in the paper. In the sheet former used to provide the pattern shown in FIG. 1, the two fabric layers are connected by transversely extending binder wires. The imprints of the knuckles of said binder wires are discernible on the paper side as small irregularities of the knuckle pattern, while the monoplanar character of the paper face is not impaired.

Figure 7:
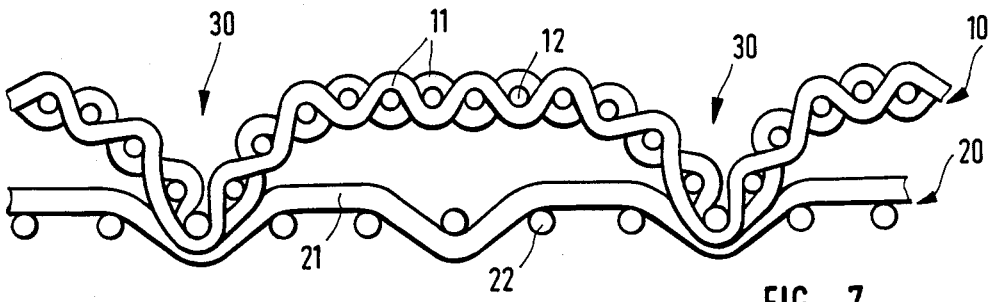

FIGS. 2 and 3 show the imprint of a paper machine fabric having small and larger depressions, respectively, in the paper face. The areas 30 of the imprint are caused by the depressions which are formed at the sites where the two fabric layers are interconnected by additional wires, so called binder wires, or by the structural longitudinal and/or transverse wires of the upper fabric layer. FIG. 2 sows the imprint of a papermachine fabric in which the two fabric layers are interconnected by additional transverse binder wires. FIG. 3 shows the imprint of a papermachine fabric in which the two fabric layers are interconnected in that the structural longitudinal wires of the upper fabric layer are interwoven with the lower fabric layer. The width and length of the depressions can be determined in that at the same time a plurality of binder wires or structural longitudinal or transverse wires of the upper fabric layer participate in the formation of each individual depression. When the upper fabric layer is attached by its transverse wires, the depression will be narrower, especially if the attachment is made by a single transverse wire of the upper fabric layer. The depression will be wider if two neighboring transverse wires are used for attachment as will be explained hereinafter in conjunction with FIG. 7. At the same time, the depression will be more pronounced if the transverse wire, and, in addition, the longitudinal wire of the upper fabric layer, are used for attachment.

Figure 4:
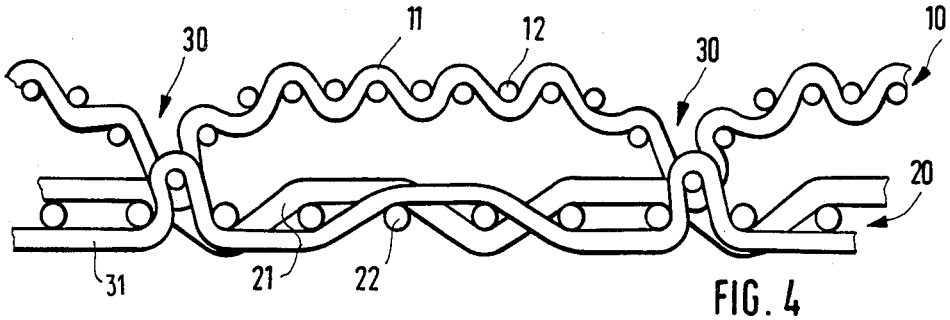
FIGS. 4 to 7 are sectional views in the transverse direction of various examples of the papermachine fabric of the invention.

FIG. 4 is a transverse sectional view of a two layer papermachine fabric which is woven flat so that the warp forms the longitudinal wires and the weft the transverse wires. The upper fabric layer 10 is woven in plain weave, while the lower fabric layer 20 is a three harness twill warp runner, i.e., the long weft floatings are on top and support the upper fabric layer 20, and the long warp floatings are disposed on the underside. For simplicity's sake this weave combination will be discussed in all the following examples, although other weaves and other modes of interweaving the upper and lower fabric layers 10, 20 are likewise possible. The lower fabric layer 20, for example, may be a three harness weft runner in which the long weft floatings project in the downward direction.

According to FIG. 4, the upper fabric layer 10 is formed by transverse wires 11 and longitudinal wires 12 woven in plain weave. The lower fabric layer 20 is formed by transverse wires 21 and longitudinal wires 22 woven in three harness twill weave. Both fabric layers are interconnected by an additional transverse binder wire 31 at the interweaving site where the depression 30 forms. At the depression 30 the transverse binder wire 31 interweaves with the upper longitudinal wire 12 and draws the upper fabric layer 10 deeply downwardly at this site so that the upper transverse wires 11 dive between the adjacent lower transverse wires 21. The frequency and distribution of the sites of interweaving may be selected arbitrarily. It is advantageous when the transverse binder wires 31 passes underneath two stable lower longitudinal wires 22 in order that the tensile force is distributed over several wires in the lower fabric layer 20 and the upper fabric layer 10, consisting of softer synthetic resin material, forms pronounced dimples or depressions 30.

Figure 5:
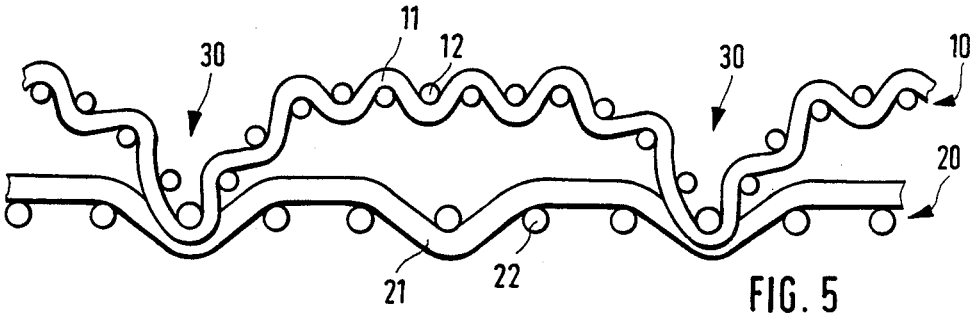

FIG. 5 also shows a papermachine fabric in transverse section in which the two fabric layers 10, 20 are interconnected by the upper transverse wire 11 passing below the lower longitudinal wire 22 whereby it forces the upper fabric layer 10 to forma dimple or depression 30. Hence interweaving here is effected by the structural transverse wires 11 of the upper fabric layer 10.

Figure 6:
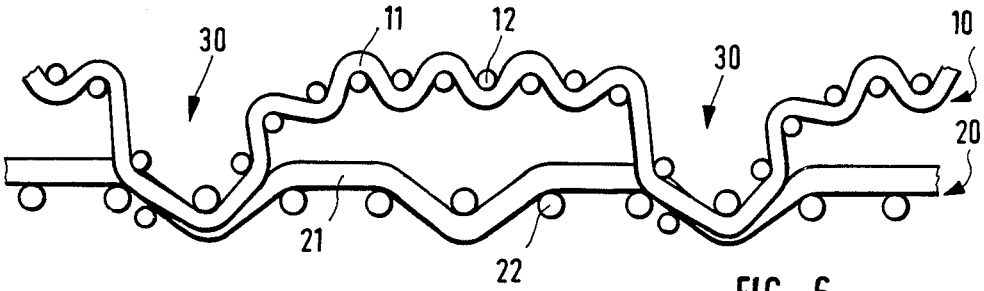

In the example of FIG. 6 the two fabric layers 10, 20 are interconnected in that the upper transverse wire 11 and the upper longitudinal wires 12 pass around longitudinal wires 22 and transverse wires 21 of the lower fabric layer 20, respectively.

FIG. 7 again shows, in transverse section, how two successive transverse wires 11 of the upper fabric layer 10 take part in the interweaving. The depression 30 thereby becomes more pronounced and extends farther in longitudinal direction. Both transverse wires 11 of the upper fabric layer 10 pass below one longitudinal wire 22 of the lower fabric layer 20.

Figure 8:
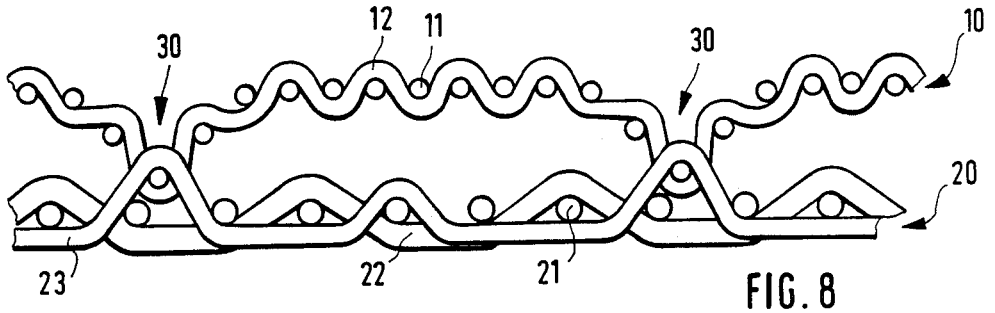
FIGS. 8 and 9 are sectional views in the transverse direction of various examples of the papermachine fabric.

FIG. 8 shows a papermachine fabric according to the invention in longitudinal section. The longitudinal wires 22 of the lower fabric layer 20 form long floatings on the running side to provide a wrap runner hving a flat or open mode of weaving. The two fabric layers 10, 20 are interwoven by additional longitudinal binder wires 23. The longitudinal binder wire 23 passes around only one of the thin transverse wires 11 of the upper fabric layer and passes underneath two of the thick stable transverse wires 21 of the lower fabric layer 20. The longitudinal wires of the upper fabric layer and the lower fabric layer are spatially offset.

Figure 9:
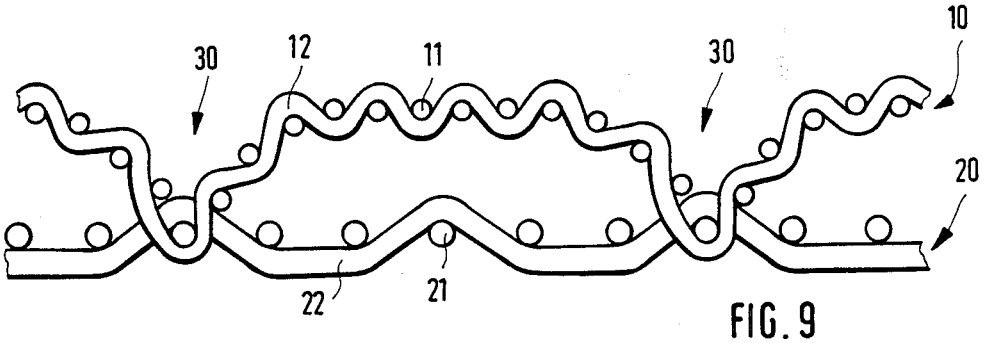

FIG. 9 shows a papermachine fabric in longitudinal section having interconnected upper and lower fabric layers with the longitudinal wire 12 of the upper fabric layer 10 passing underneath one transverse wire 21 of the lower fabric layer 20.

Figure 10:
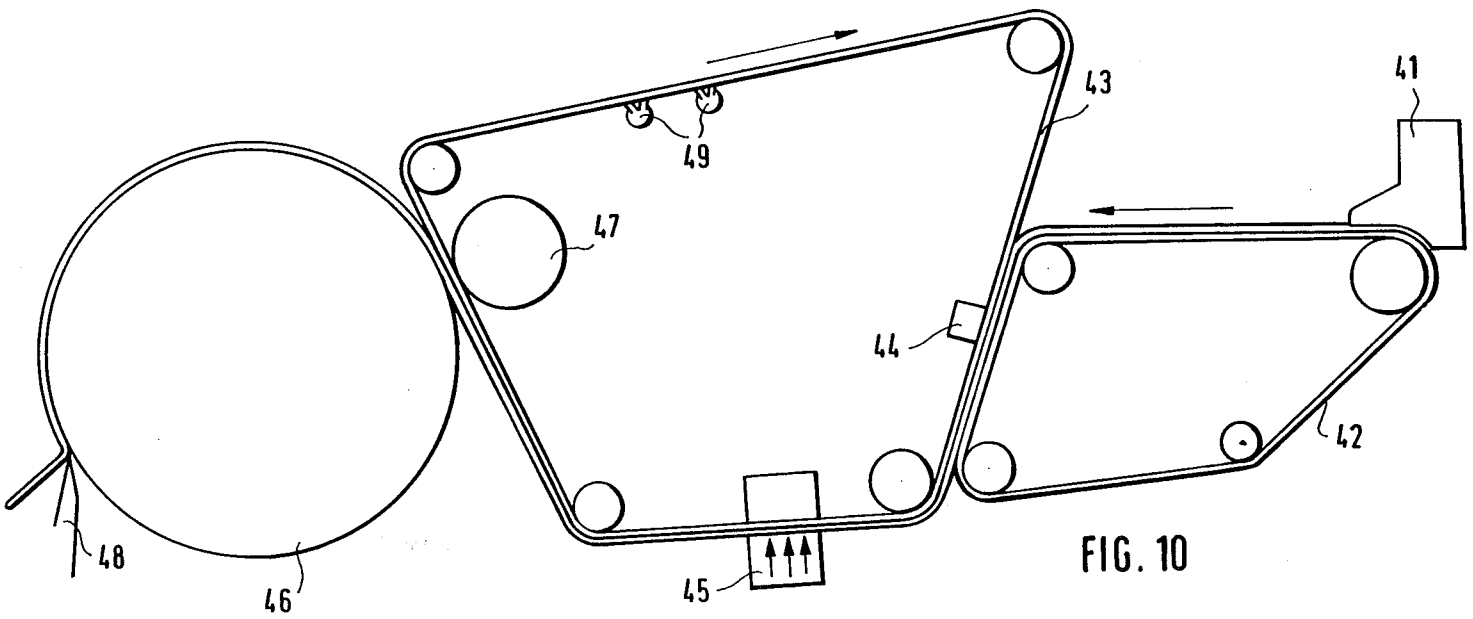
FIG. 10 schematically illustrates the construction of the sheet forming section of a papermaking machine in which the papermachine fabric of the invention is employed as an embossing fabric.

FIG. 10 is a diagrammatic view of the construction of a tissue papermachine. From the headbox 41 the pulp is discharged onto a conventional tissue sheet forming fabric 42 through which the major portion of the water content runs off. On the sheet forming fabric 42 a smooth paper web is formed. The paper web is then deflected and convened between the sheet former 42 and an embossing fabric 43 past a suction box 44. In the region of the suction box 44 the paper web is embossed and reshaped in that raised areas with higher fiber concentration and depressions with lower fiber concentration are formed. The paper web is then removed from the sheet forming fabric 42 and is supported only by the embossing fabric 43. The paper web is further dried by means of a blow drier blowing hot air through the paper web. The paper web is then received by a steam heated drier cylinder 46, and at the take over point an additional second embossment of the paper web is effected by a pressing roll 47 urging the embossing fabric 43 carrying the paper web against the drier cylinder 46. The dry paper web is then removed from the drier cylinder 46 by means of a scraper 48. The embossing fabric 43 in this example is a two layer papermachine fabric according to the invention with depressions in the fine upper fabric layer.

Figure 11:
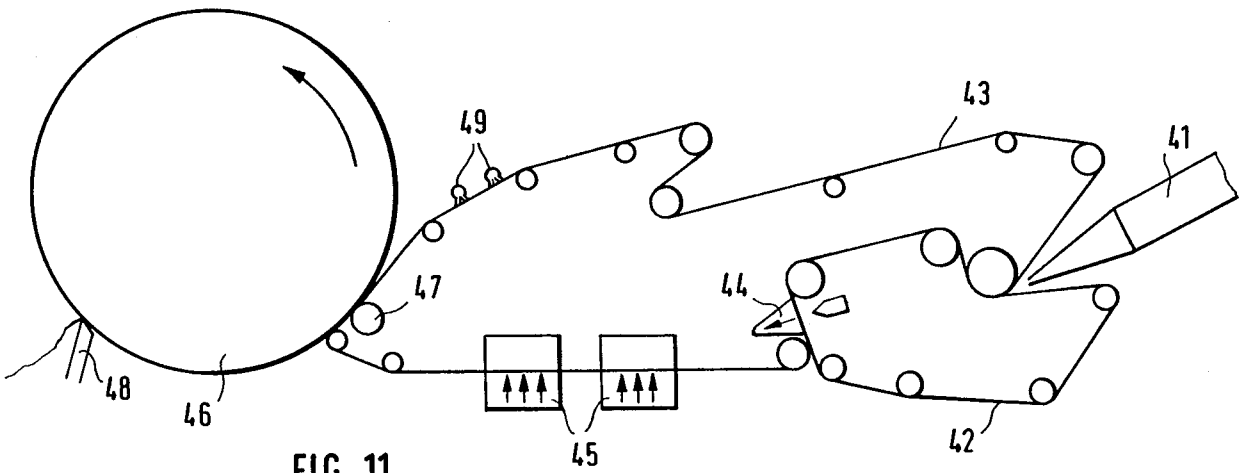
FIG. 11 schematically illustrates a twin wire forming machine in which the papermachine fabric of the invention is employed as one of the two sheet formers.

FIG. 11 shows the use of the papermachine fabric of the invention in a twin wire former. The headbox discharges the pulp into the gap formed by a lower sheet former 42 of conventional construction and by an embossing fabric according to the invention serving as as second sheet former. During the sheet formation the paper web is already embossed. At the same time the suction box 44 promotes the transition of the paper web to the embossing fabric 43 as the sole support from which the paper web is then advanced through blow driers 45 to a drier cylinder 46. On the return path from the drier cylinder 46 to the headbox 41 the embossing fabric 43 is cleaned by spray tubes 49. The final paper web is removed from the drier cylinder 46 by means of a scraper 48.

While the invention has been particularly shown and described with reference to preferred embodiments thereof it will be understood by those in the art that the foregoing and other changes in form and details may be made therein without departing from the spirit and scope of the invention.

What is claimed is:

1. A papermachine fabric for the production of tissue paper comprising two fabric layers interconnected at a plurality of points including a coarse lower fabric layer and a fine upper fabric layer with each fabric layer comprised of woven transverse and longitudinal wires having an open area greater than thirty percent and with the upper fabric layer being interwoven with the lower fabric layer and being drawn into the lower fabric layer to form depressions in the upper fabric layer distributed in the manner of a pattern at the points of interconnection.

2. A papermachine fabric according to claim 1 wherein the two fabric layers are interconnected by binder wires extending in one of the longitudinal and transverse directions and consisting of monofilaments of hard synthetic resin and wherein the upper fabric layer is comprised of fine transverse and longitudinal wires of softer, readily deformable synthetic resin.

3. A papermachine fabric according to claim 2 wherein the transverse wires of the lower fabric layer are of softer and more readily deformable synthetic resin than the longitudinal wires of the lower fabric layer.

4. A papermachine fabric according to claim 1, wherein the two fabric layers are interwoven at each point of interconnection by having at least one upper transverse wire passing below a lower longitudinal wire.

5. A papermachine fabric according to claim 1, wherein the two fabric layers are interwoven at each point of interconnection by having an upper transverse wire and an upper longitudinal wire passing below a lower transverse wire and a lower longitudinal wire.

6. A papermachine fabric according to claim 1, wherein the two fabrics are interwoven at each point of interconnection by having two successive upper transverse wires passing below one lower longitudinal wire.

7. A papermachine fabric according to claim 1, wherein the two fabric layers are interwoven at each point of interconnection by having an upper longitudinal wire passing beneath a lower transverse wire.

* * * * *